US008905323B2

(12) United States Patent
Ortmann et al.

(10) Patent No.: US 8,905,323 B2
(45) Date of Patent: Dec. 9, 2014

(54) GUIDE PLATE FOR THE LATERAL GUIDANCE OF A RAIL AND SYSTEM FOR FASTENING A RAIL

(75) Inventors: Marcus Ortmann, Arsberg (DE); Dierk Bressel, Iserlohn (DE)

(73) Assignee: Vossloh-Werke GmbH, Werdohl (DE)

( * ) Notice: Subject to any disclaimer, the term of this patent is extended or adjusted under 35 U.S.C. 154(b) by 18 days.

(21) Appl. No.: 13/988,863

(22) PCT Filed: Oct. 7, 2011

(86) PCT No.: PCT/EP2011/067556

§ 371 (c)(1),
(2), (4) Date: Jul. 1, 2013

(87) PCT Pub. No.: WO2012/069246

PCT Pub. Date: May 31, 2012

(65) Prior Publication Data

US 2013/0284819 A1 Oct. 31, 2013

(30) Foreign Application Priority Data

Nov. 23, 2010 (DE) ..... 10 2010 060 745

(51) Int. Cl.
*E01B 9/00* (2006.01)
*E01B 9/30* (2006.01)

(52) U.S. Cl.
CPC .. *E01B 9/00* (2013.01); *E01B 9/303* (2013.01)
USPC ..... 238/349; 238/315; 238/351

(58) Field of Classification Search
USPC ..... 238/264, 349, 310, 351, 315, 338, 283
See application file for complete search history.

(56) References Cited

U.S. PATENT DOCUMENTS

| | | | | |
|---|---|---|---|---|
| 4,066,212 | A * | 1/1978 | Sonneville | 238/349 |
| 4,802,623 | A * | 2/1989 | Fasterding et al. | 238/44 |
| 4,907,740 | A * | 3/1990 | Oberweiler et al. | 238/283 |
| 5,096,119 | A * | 3/1992 | Schultheiss et al. | 238/349 |
| 5,125,573 | A * | 6/1992 | Vanotti | 238/351 |
| 6,257,495 | B1 * | 7/2001 | Eisenberg | 238/349 |
| 7,854,392 | B2 * | 12/2010 | Hauschild et al. | 238/349 |
| 7,992,798 | B2 * | 8/2011 | Bosterling et al. | 238/349 |

(Continued)

FOREIGN PATENT DOCUMENTS

| | | |
|---|---|---|
| CN | 1216078 A | 5/1999 |
| DE | 2806817 B1 | 3/1979 |

(Continued)

OTHER PUBLICATIONS

"Schienenbefestigungssysteme für Betonschwellen System W 14", Brochure from Vossloh Fastening Systems GmbH, 4 pages, Werdohl, Germany.

(Continued)

*Primary Examiner* — Jason C Smith
(74) *Attorney, Agent, or Firm* — The Webb Law Firm

(57) ABSTRACT

Disclosed is a guide plate for the lateral guidance of a rail and to a rail fastening system with such a guide plate. The guide plate has a contact area, on which the guide plate stands in the completely assembled state, and a support portion, which is associated with the counter bearing, with a support face, with which the guide plate 1 is supported, in the completely assembled state, on a counter bearing.

10 Claims, 3 Drawing Sheets

(56) References Cited

U.S. PATENT DOCUMENTS

| | | | | |
|---|---|---|---|---|
| 8,052,068 | B1 * | 11/2011 | Renneckendorf et al. | 238/349 |
| 8,181,887 | B2 * | 5/2012 | Seifert et al. | 238/310 |
| 8,727,230 | B2 * | 5/2014 | Bednarczyk et al. | 238/349 |
| 2004/0232254 | A1 * | 11/2004 | Kowalski | 238/264 |
| 2008/0257972 | A1 * | 10/2008 | Vorderbruck et al. | 238/331 |
| 2013/0015256 | A1 * | 1/2013 | Bednarczyk et al. | 238/315 |
| 2013/0284819 | A1 * | 10/2013 | Ortmann et al. | 238/264 |

FOREIGN PATENT DOCUMENTS

| | | | |
|---|---|---|---|
| DE | 3324225 | A1 | 1/1985 |
| DE | 4101198 | C1 | 3/1992 |
| DE | 19607339 | A1 | 8/1997 |
| DE | 10254679 | A1 | 7/2004 |
| DE | 202007018500 | U1 | 9/2008 |
| DE | 102008032353 | B3 | 10/2009 |
| EP | 0808946 | A1 | 11/1997 |
| WO | 9732083 | A1 | 9/1997 |
| WO | 03046284 | A1 | 6/2003 |
| WO | 2004048697 | A1 | 6/2004 |

OTHER PUBLICATIONS

"Rail fastening systems for concrete sleepers System W 14", Brochure from Vossloh Fastening Systems GmbH, 4 pages, Werdohl, Germany.

* cited by examiner

GUIDE PLATE FOR THE LATERAL GUIDANCE OF A RAIL AND SYSTEM FOR FASTENING A RAIL

BACKGROUND OF THE INVENTION

1. Field of the Invention

The invention relates to a guide plate for the lateral guidance of a rail on a counter bearing, which is formed on a base, which has a contact area, on which the guide plate stands in the completely assembled state, the guide plate having a support portion associated with the counter bearing, with a support face, with which the guide plate, in the completely assembled state, is supported on the counter bearing.

The invention moreover relates to a system for fastening a rail, in which a guide plate of the type disclosed above is used.

2. Description of Related Art

As described in the brochure published by the Applicant "Schienen-Befestigungs-Systeme für Betonschwellen—System W 14", guide plates and fastening systems of the type in question here are used in the fastening of rails on a firm base, which can be formed, for example, by a concrete sleeper or a concrete slab. The rail to be fastened generally stands by way of a resilient intermediate layer directly on the firm base. The rail is guided laterally by guide plates, which in each case form between them in pairs a precisely tracked rail channel.

In the known fastening systems of the type mentioned above, the forces introduced via the rail are guided by means of the guide plate directly into the base carrying the rail.

For this purpose, a shoulder, on which the associated guide plate is supported, is formed on the respective base for each of the guide plates.

A ω-shaped tensioning clamp is generally mounted on the guide plate and, in the completely assembled state, presses with the free end portions of its spring arms on the free upper side of the rail foot of the rail to be fastened. On a curved support portion opposing their free end portion, in each case, and supported on the guide plate, the spring arms of the tensioning clamp pass into a central loop, which is braced by means of a tensioning screw against the firm base.

Apart from the prior art described above, an angled guide plate of the type disclosed at the outset is described in DE 41 01 198 C1 and is intended to fasten a rail by means of a ω-shaped tensioning clamp. Provided in the known angled guide plate here are indentations, in which the central part of the tensioning clamp bent in a U-shape lies after assembly. Moreover, the known angled guide plate has a groove, which extends parallel to the rail in the assembly position. After assembly, the portions of the tensioning clamp leading outwardly are supported longitudinally and transversely with respect to the rail to be fastened, in each case, in this groove.

To improve its permanent electrical insulation, the known angled guide plate has portions laterally moulded onto it, the surface of which is inclined, so that water reaching it is guided away from the angled guide plate. However, this only applies to the water reaching the side portions. On the other hand, in the central region of the angled guide plate, accumulations of water can continue to form, by means of which, on the one hand, corrosion can be triggered on the parts of the respective clamping element standing in the accumulation of water and, on the other hand, the electrical insulation of the clamping element and, associated with this, the insulation of the rail in electrically conductive contact with the clamping element can be impaired.

It has been proposed in DE 102 54 679 B4, for the elimination of this drawback, to also form at least one run-off face in the central region of the surface of the angled guide plate, said run-off face guiding liquid reaching the surface at least in portions away from the relevant respective portion. Rain water, for example, or other liquids collecting on the angled guide plate can be prevented by a suitable arrangement of the run-off faces. In order to protect, in particular, the opening for the fastening screw to pass through from the penetration of water here, the run-off face adjoins the opening, according to the invention, in such a way that liquid reaching the region of the opening is guided away from the opening. For this purpose, the relevant run-off face can be formed as a collar at least partially surrounding the opening. This collar can simultaneously serve to fix the position of the fastening portion on the angled guide plate in that it forms a stop, on which the inside of the fastening portion of the spring element positively rests in the assembly position.

With an angled guide plate according to the invention, the upper side can be configured in such a way that a conventionally formed spring element mounted on the angled guide plate is laterally guided in the region of at least one of its portions extending transverse to the rail, in the completely assembled state. The spring element can thus be reliably prevented from spreading apart because of high clamping forces, which are required in order to apply the high holding forces required for a permanently secure fastening of highly loaded rails.

Despite the measures described above for improving the electrical insulation, the requirement has emerged in practice to further improve the protection of the rail against an electrically conductive contact with the base carrying the rail, in each case.

SUMMARY OF THE INVENTION

In relation to the system, the achievement according to the object of the invention disclosed above consists in a system of this type being formed according to claim 10.

A guide plate according to the invention for the lateral guidance of a rail on a counter bearing, which is formed on a base, which has a contact area, on which the guide plate stands in the completely assembled state, in agreement with the prior art given at the outset, has a support portion associated with the counter bearing, with a support face, with which the guide plate is supported, in the completely assembled state, on the counter bearing.

A shoulder, by means of the end face of which, associated with the counter bearing, the support face of the support portion is extended, is now formed on the support portion according to the invention. At the same time, the maximum height of the shoulder above the bearing face of the guide plate associated with the contact area of the base is greater than the maximum height of the counter bearing supporting the guide plate in the completely assembled state above the contact area of the base.

In a guide plate according to the invention, the shoulder formed on the support portion according to the invention is thus dimensioned such that, when the guide plate is completely assembled, it projects upwardly above the counter bearing. The shoulder formed in this manner accordingly forms a barrier for moisture which collects on the guide plate in practical use and in conventional guide plates and, because of surface tension and adhesion or cohesion forces, is even found as a thin film on the surface of the conventional guide plates where a larger liquid accumulation does not directly occur. Owing to the shoulder provided according to the invention, the creepage path relevant to the electrical insulation is extended, so in a guide plate according to the invention, the resistance to the formation of creepage flows, which overcome the support portion, and creepage flows penetrating to the counter bearing or to the base carrying the guide plate is increased.

At the same time, the shoulder provided according to the invention reduces the risk of the penetration of liquid into the unavoidable gap in the assembled state between the guide plate and counter bearing. Accordingly, in a guide plate according to the invention, the possibility basically existing as a consequence of the capillary effect, of the penetration of larger quantities of liquid into the relevant gap is significantly reduced, by which the development of electrical bridges could otherwise be promoted. Accordingly, the elevated shoulder according to the invention also forms a barrier for moisture, which could otherwise reach the guide plate via the counter bearing, where it could impair the electrical insulation of the clamping element or rail used in each case or could trigger corrosion.

By means of the design according to the invention of a guide plate, an effective improvement of the electrical insulation of the components consisting of a conductive material and supported on and at the guide plate is thus brought about with conceivably simple means.

Basically, the advantageous effect of the shoulder formed on a guide plate according to the invention already occurs when the shoulder moulded onto the support portion is raised above the support portion to such an extent that it projects upwardly, in the completely assembled state, over the counter bearing associated with the guide plate, without its end face associated with the counter bearing resting on the counter bearing. However, going beyond this, if the gap present, in the assembled state, between the counter bearing and guide plate is also to be additionally protected against penetrating liquid and dirt, according to one configuration of the invention, the shape of the end face of the shoulder associated with the counter bearing can be adapted to the shape of the counter bearing in such a way that the end face of the shoulder, when the shoulder is completely assembled, rests tightly and positively on the counter bearing.

Advantageously, the shoulder can be shaped in such a way that when the guide plate is braced on the base, it acts with light pressure on the counter bearing, so that the sealing effect of the end face of the shoulder then lying on the counter bearing is additionally supported. For this purpose, the shoulder can be formed projecting in the direction of its end face associated with the counter bearing. This embodiment of the invention in practice allows the further advantage that the guide plate, in the completely assembled state, can be supported on the counter bearing not only in a horizontal direction oriented transverse to the rail to be fastened, but also in a direction which has a vertical component.

In order to optimise the correct fit of the end face present on the shoulder provided according to the invention on the contact face of the counter bearing associated with it, the end face of the shoulder associated with the counter bearing and at least the region adjoining it of the support face of the support portion can be curved in the manner of a groove.

A guide plate according to the invention, like the known guide plates of the type described at the outset, will in practice have, on its upper side remote from its bearing face, a bearing face for a spring element to be applied to hold down the rail to be fastened, said bearing face being limited in the direction of the shoulder by a channel, in which, when the guide plate is completely assembled, a torsional portion of the spring element is seated. An additional protection against water collecting on the guide plate can be achieved here according to a further configuration of the invention in that the channel is open at at least one of its ends and the base of the channel is formed sloping in the direction of this end. Liquid reaching the channel can flow away laterally in this manner via the open end of the channel. Likewise, it is obviously possible to provide a separate drainage opening in the region of the channel to which the bevelled base portion leads and via which liquid can flow off.

A particularly simple and simultaneously effective variant of the invention is characterised in this context in that the channel is open at its two ends and a portion of the base of the channel is in each case formed sloping in the direction of one of these ends. If a ω-shaped tensioning clamp is used in combination with a guide plate according to the invention, as a spring element, the mutual insulation of the torsional portions of the tensioning clamp seated in the channel when the tensioning clamp is completely assembled on the guide plate can be improved in that there is formed between the relevant portions of the channel, a web, which is oriented transverse to the longitudinal direction of the channel and separates the portions from one another. The web can also act as a guide here, which additionally secures the proper position of the tensioning clamp on the guide plate.

To brace the spring element seated on the guide plate, tensioning screws are generally screwed through a through-opening, which is formed in the guide plate and leads from its upper side to its lower side, into a plug inserted in the base. Since a collar raised above the bearing face for the spring element and running round the relevant through-opening is formed on the upper side of the guide plate, liquids collecting on the guide plate can be prevented from reaching the through-opening and accumulating there. The tensioning means provided to brace the spring element and generally consisting of a conductive material can also thus be reliably protected against a corrosive attack. Moreover, the danger is also minimised of an electrically conducive contact between the rail and the base being produced by liquid located in the through-opening.

In order to minimise the weight of the guide plate according to the invention, at least one recess can be formed therein from its lower side.

In accordance with the above statements, a system according to the invention for fastening a rail on a base, on which a counter bearing in the form of a shoulder raised over a contact area formed on the base is formed, comprises a guide plate formed according to the invention, the shoulder formed on the guide plate, in the completely assembled state, with its end face, on the one hand being associated with the counter bearing and, being arranged with its free upper edge above the counter bearing.

A configuration of a system according to the invention, which is particularly advantageous for practical use, which additionally has the advantage of a particularly precise, positionally secure positioning of the guide plate, consists in there being formed in the region of the transition to the counter bearing between the contact area and the counter bearing, a depression, in which, in the completely assembled state, a projection formed on the lower side of the guide plate is seated. The guide plate is thus formed therein in the manner of an angled guide plate known per se of the type disclosed at the outset, which, in practical use, is seated on a base formed in a likewise known manner.

BRIEF DESCRIPTION OF THE DRAWINGS

The invention will be described in more detail below with the aid of exemplary embodiments. In the drawings.

DETAILED DESCRIPTION OF THE INVENTION

Figure 1:
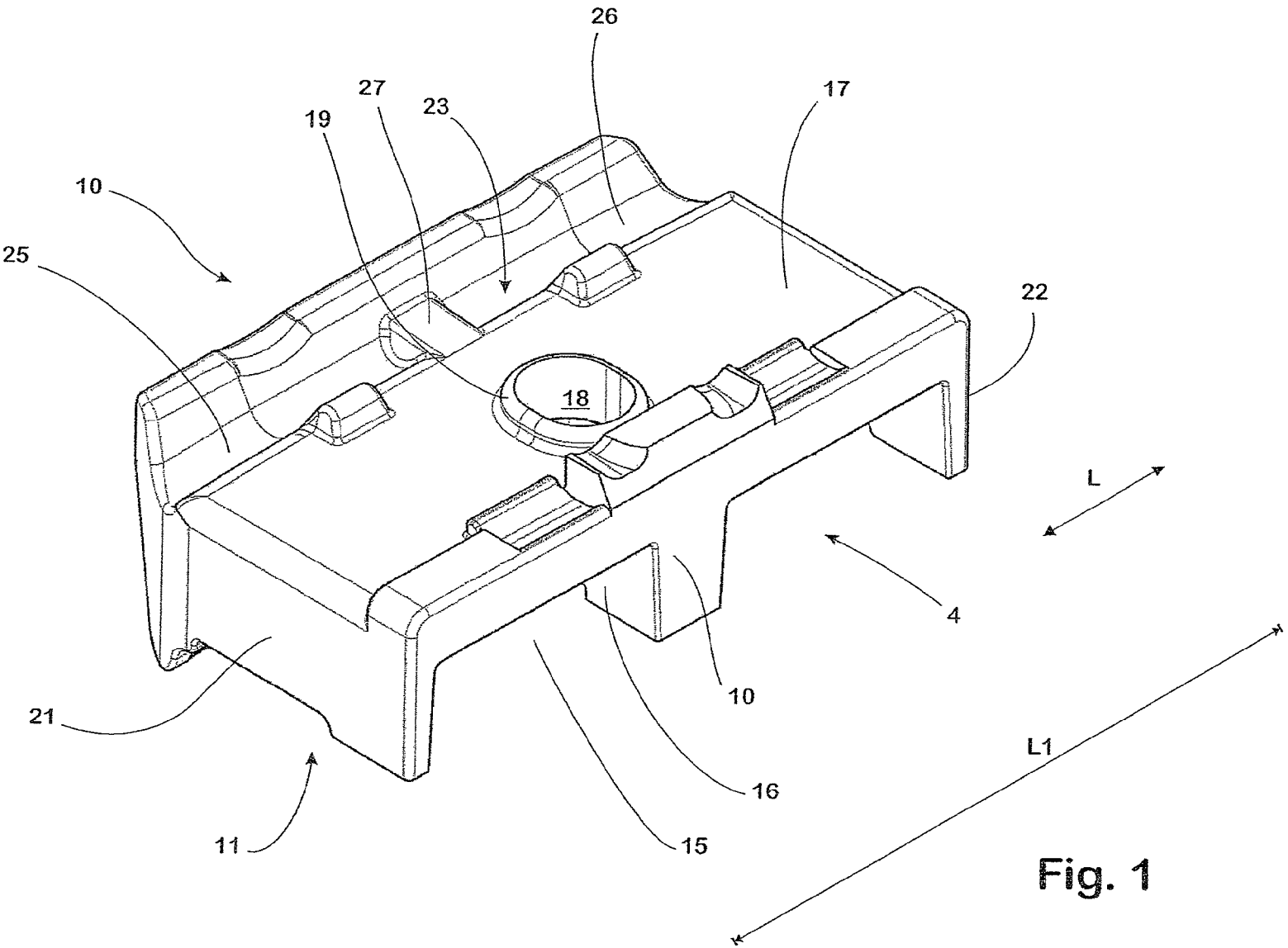
FIG. 1 shows a guide plate in a perspective view.
Figure 2:
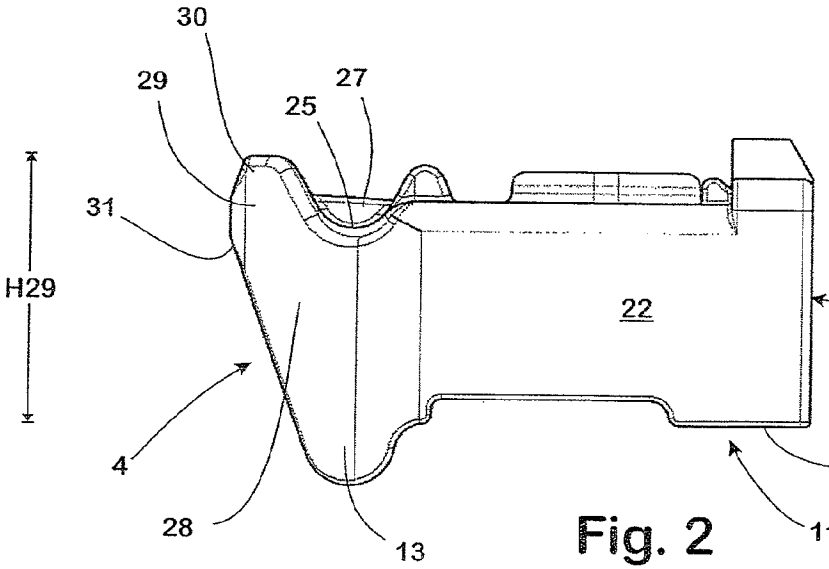
FIG. 2 shows a guide plate in a side view.
Figure 3:
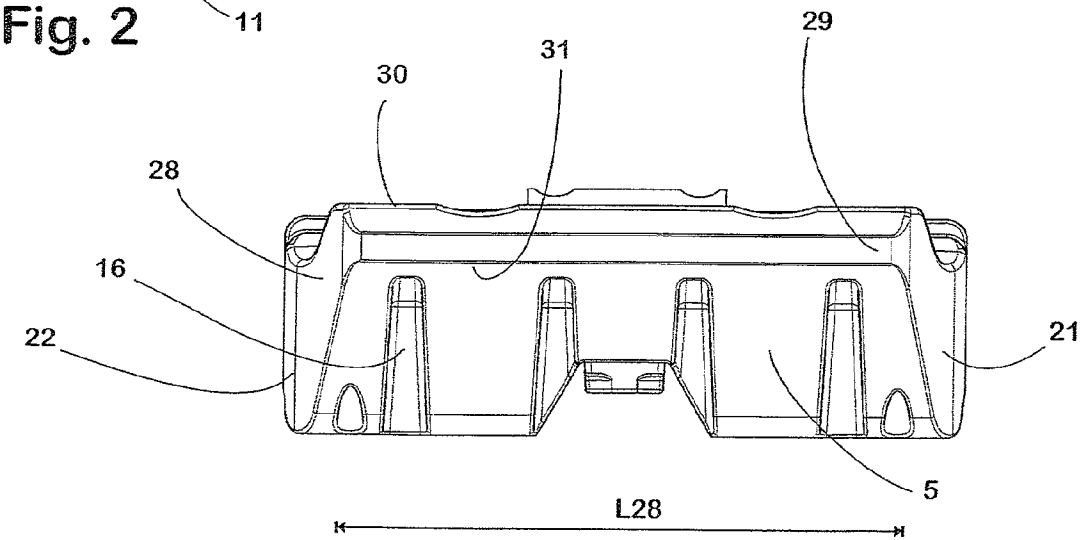
FIG. 3 shows the end face of the guide plate associated with a counter bearing, in a front view.
Figure 4:
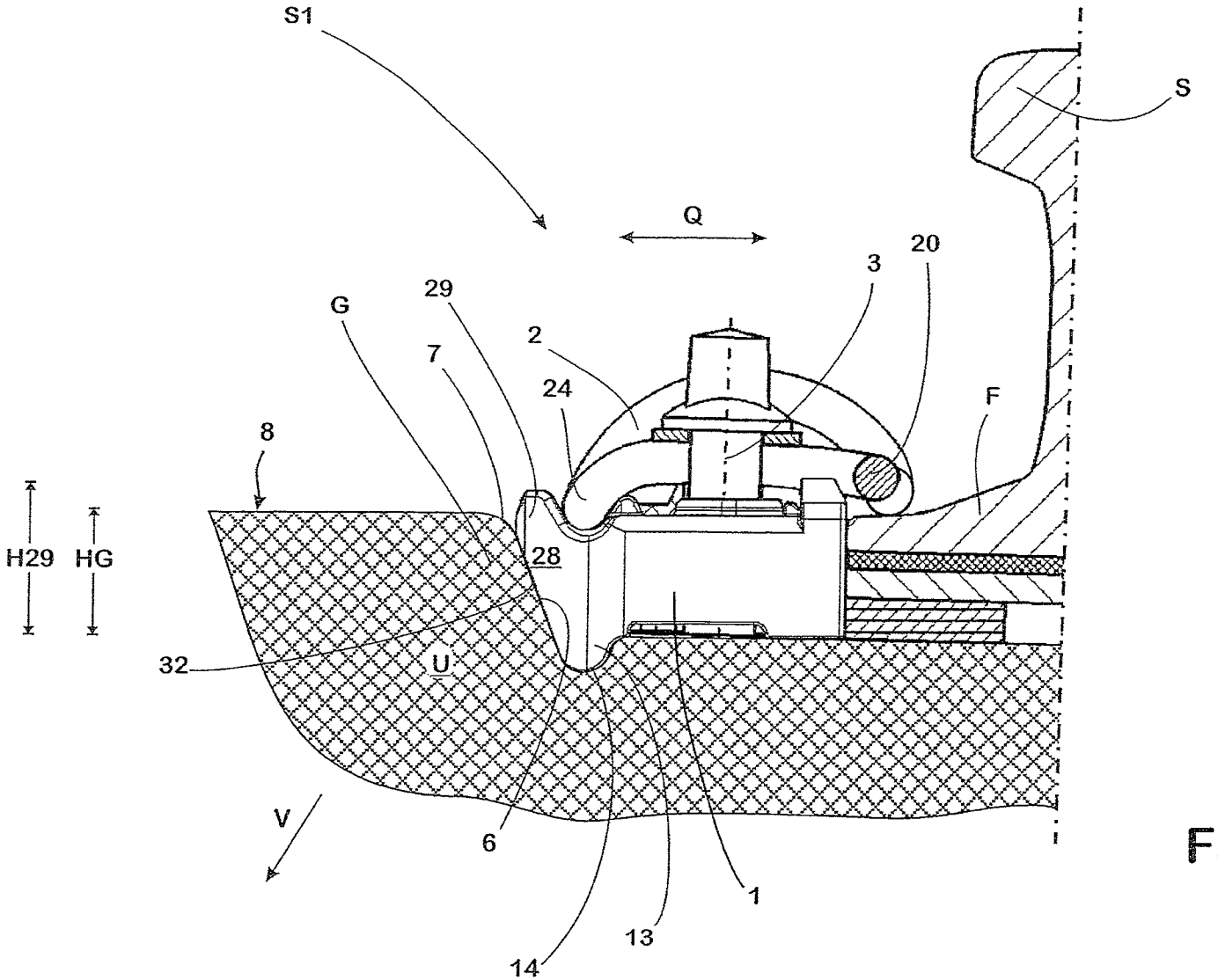
FIG. 4 shows a fastening point for a rail in a lateral partly sectional part view.

FIG. 4 shows a system S1 for fastening a rail S on a base U formed by a sleeper made of concrete. The system S1, together with a second system, not visible here, which is identically constructed and fastened to the opposing side of the rail S, forms a fastening point, in which the rail S is resiliently held on the base U.

The system S1 comprises a guide plate 1, a ω-shaped tensioning clamp 2 and a tensioning screw 3 to brace the tensioning clamp 2 against the base U.

The guide plate 1 produced in one piece from a plastics material or another adequately rigid material has the basic shape of a conventional angled guide plate and has an end face 4 with a support face 5, by means of which the guide plate 1, in the completely assembled state (FIG. 4), is supported on a counter bearing G formed on the firm base U.

The counter bearing G has the shape of a shoulder step extending over the width of the base U formed as a sleeper, on which a counter bearing face 6 associated with the guide plate 1 and running obliquely downward, is formed. The counter bearing face 6, in a rounded edge 7, passes into the flat, horizontally oriented upper side 8 of the counter bearing G.

Furthermore, the guide plate 1 has a second end face 9 with a contact face 10, on which, when the guide plate 1 is completely assembled, the rail foot F of the rail S to be fastened rests.

Formed on the lower side 11 of the guide plate 1 is a bearing face 12, with which the guide plate 1 is seated in the assembly position on the contact area, associated with the guide plate 1, of the flat base U. In the direction of the first end face 4, the bearing face 12 is limited by a projection 13, which extends over the length L1 of the guide plate 1 and which, in a manner known per se, when the guide plate 1 is completely assembled, is seated in a correspondingly formed channel 14, which is formed between the counter bearing G and the contact area of the base U into the base U.

Proceeding from the bearing face 12, to minimise the weight and the material outlay required for production, formed into the guide plate 1 are recesses 15, which extend to the contact face 10 of the second end face 9. In this case, the guide plate 1 is reinforced in the region of the recesses 15 inter alia by ribs 16, which are oriented transverse to the end faces 4, 9, in the manner of an arch construction, so an optimum dimensional stability is secured with a minimum material requirement.

Proceeding from its free surface 17, a through-opening 18 leading to the lower side 11 is formed into the guide plate 1, through which through-opening the tensioning screw 3 is inserted during the assembly of the system S1 in a manner known per se, in order to screw it, to brace the tensioning clamp 2, in a plastics material plug, not visible here, let into the base U.

To optimise the electrical insulation, the through-opening 18 is surrounded on the surface 17 by a peripheral collar 19. The latter prevents liquid that collects on the surface 17 reaching the through-opening 18 and forming an electrically conductive bridge to the base U there. At the same time, the peripheral collar 19 is used as a guide and support for the central loop 20 of the tensioning clamp 2 to be assembled on the guide plate 1.

To prevent liquid reaching the through-opening 18 via the tensioning clamp 2, run-off bevels, not shown here, can be formed on the collar 19. These can fall away obliquely, proceeding from the inner edge of the collar 19, in the direction of one of the respective lateral side walls 21, 22 of the guide plate 1 extending between the end faces 4, 9, so that water or another liquid, which arrives there on the guide plate 1 from the tensioning clamp 2, is guided away laterally onto the surface 17 of the guide plate 1. The surface 17 itself may also be bevelled sloping slightly in the direction of the first end face 4, so liquid reaching it can flow away in the direction of the relevant end face 4.

In the direction of the first end face 4, the surface 17 of the guide plate 1 is limited by a channel 23 which extends in the longitudinal direction L and in which, in a manner also known per se, in the completely assembled state, the torsional portions 24 of the ω-shaped tensioning clamp 2 are seated, of which in FIG. 4 only one torsional portion 24 is visible because of the direction of the section and side view selected there.

The base of the channel 23 open at its ends associated with the side walls 21, 22 can also be divided proceeding from the centre of the channel 23 into two oblique faces 25, 26, of which one slopes in the direction of one wall 21 and the other in the direction of the other wall 22.

Formed in the centre of the channel 23 is a web 27, which extends transverse to the longitudinal direction L via the channel 23 and separates the two oblique faces 25, 26 from one another. The height and the length of the web 27 measured in the longitudinal direction L are dimensioned here such that, when the system S1 is completely assembled, the web 27 keeps the torsional portions 24 of the ω-shaped tensioning clamp 2 insulated from one another at a defined spacing.

Adjoining the channel 23 in the direction of the first end wall 4 is a support portion 28, which forms the termination of the guide plate 1 in the direction of the first end face 4 and on which the support face 5 is formed. The support portion 28 carries a shoulder 29, which extends over its length L28 and, on the one hand, projects upwardly beyond the surface 17 of the guide plate 1 and, on the other hand, projects in the direction of the end face 4. The height H29 of the upper free edge 30 over the bearing face 12 of the guide plate 1 is dimensioned here in relation to the height HG, with which the upper side 8 of the counter bearing G is arranged over the bearing face of the base U, such that the shoulder 29 projects over the counter bearing G when the guide plate 1 is completely assembled. At the same time, the end face 31 of the shoulder 29, which is associated with the counter bearing G, is adapted, by curving in, to the shape of the rounded edge 7 of the counter bearing G such that the end face 31, as an extension of the support face 5 of the guide plate 1, when the guide plate 1 is completely assembled, rests with its end face 31 flat and tightly on the counter bearing G. The joint gap 32, which is inevitably present between the counter bearing G and the support portion 28 when the guide plate 1 is completely assembled, is covered by the shoulder 29 in such a way that no liquid can penetrate therein from the guide plate 1.

The shoulder 29 thus forms an effective barrier against the penetration of liquid into the joint gap 32 or the porous material of the base U, otherwise promoted by the capillary effect. In this manner, the shoulder 29 contributes to the optimised insulation of the tensioning clamp 2 generally consisting of electrically conductive steel and, associated with this, of the rail S also consisting of electrically conductive steel, relative to the base U. At the same time, the shoulder 29 stabilises the position of the guide plate 1 on the counter bearing G, in that the guide plate 1 is supported on the counter bearing G not only by its support face 5 in a direction Q oriented transverse to the longitudinal direction L of the rail S, but also in the direction V, which has a vertical component.

LIST OF REFERENCE NUMERALS

1 Guide plate
2 ω-shaped tensioning clamp 2
3 Tensioning screw
4 End face of the guide plate 1 associated with the counter bearing G
5 Support face on the end face 4
6 Counter bearing face of the counter bearing G
7 Edge of the counter bearing G
8 Upper side of the counter bearing G
9 End face of the guide plate 1 associated with the rail foot F
10 Contact face on the end face 9
11 Lower side of the guide plate 1
12 Bearing face on the lower side 11
13 Projection
14 Channel formed into the base U
15 Recesses of the guide plate 1
16 Ribs of the guide plate 1
17 Surface present on the upper side of the guide plate 1
18 Through-opening
19 Collar
20 Central loop of the tensioning clamp 2
21, 22 Side walls of the guide plate 1
23 Channel of the guide plate 1
24 Torsional portion of the tensioning clamp 2
25, 26 Oblique faces on the base of the channel 23
27 Web
28 Support portion of the guide plate 1
29 Shoulder
30 Edge
31 End face of the shoulder 29 associated with the counter bearing G
32 Joint gap
H29 Height of the upper free edge 30 above the bearing face 12 of the guide plate 1
HG Height of the upper side 8 of the counter bearing G over the contact area of the base U
L Longitudinal extent
L1 Length of the guide plate 1
L28 Length of the support portion 28
Q Direction oriented transverse to the longitudinal extent L
S Rail
S1 System for fastening the rail S
U Base formed by a concrete sleeper
V Direction with a vertical component

The invention claimed is:

1. A guide plate for the lateral guidance of a rail on a counter bearing, which is formed on a base, which has a contact area, on which the guide plate stands in the completely assembled state, the guide plate comprising a support portion, which is associated with the counter bearing, with a support face, with which the guide plate is supported, in the completely assembled state, on the counter bearing, wherein a shoulder, by means of the end face of which, associated with the counter bearing, the support face of the support portion is extended, is formed on the support portion, wherein the maximum height of the shoulder above the bearing face of the guide plate associated with the contact area of the base is greater than the maximum height of the counter bearing supporting the guide plate in the completely assembled state, above the contact area of the base, wherein the shoulder is configured projecting in the direction of its end face associated with the counter bearing, and wherein the end face of the shoulder associated with the counter bearing and at least the region adjoining it of the support face of the support portion is curved in in the manner of a groove.

2. The guide plate according to claim 1, wherein on its upper side remote from its bearing face, it has a surface for a spring element applied to hold down the rail to be fastened, which surface is limited in the direction of the shoulder by a channel, in which a torsional portion of the spring element is seated when the guide plate is completely assembled.

3. The guide plate according to claim 2, wherein at least one opening is provided in the region of the channel and the base of the channel is formed sloping in the direction of this opening.

4. The guide plate according to claim 3, wherein the channel is open at its two ends and a portion of the base of the channel is formed sloping in the direction of one of these ends, in each case.

5. The guide plate according to claim 4, wherein a web oriented transverse to the longitudinal direction of the channel, which web separates the portions from one another, is formed between the portions of the channel.

6. The guide plate according to claim 1, further comprising a through-opening, which leads from the upper side of the guide plate to the lower side thereof, on which the bearing face is formed, and in that a collar rising over the surface and running around the through-opening is formed on the surface of the guide plate.

7. The guide plate according to claim 1, wherein at least one recess is formed into it from its lower side.

8. A system for fastening a rail on a base, on which a counter bearing in the form of a shoulder rising over a contact area formed on the base is formed, with a guide plate, which is formed according to claim 1, the shoulder formed on the guide plate being associated, in the completely assembled state, by its end face with the counter bearing and, with its free upper edge, being arranged above the counter bearing.

9. The system according to claim 8, wherein the support face of the support portion of the guide plate and the end face of the shoulder of the guide plate rest positively on the counter bearing.

10. The system according to claim 8, wherein a depression, in which, in the completely assembled state, a projection formed on the lower side of the guide plate is seated, is formed in the region of the transition to the counter bearing between the contact area and the counter bearing.

* * * * *